US011201425B2

(12) United States Patent
Mizusawa et al.

(10) Patent No.: US 11,201,425 B2
(45) Date of Patent: Dec. 14, 2021

(54) ELECTRICAL CONNECTOR FOR FLAT CONDUCTORS

(71) Applicant: Hirose Electric Co., Ltd., Yokohama (JP)

(72) Inventors: Shoichi Mizusawa, Yokohama (JP); Hiroyuki Yamazaki, Yokohama (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/065,048

(22) Filed: Oct. 7, 2020

(65) Prior Publication Data

US 2021/0111503 A1 Apr. 15, 2021

(30) Foreign Application Priority Data

Oct. 10, 2019 (JP) ..... JP2019-186768

(51) Int. Cl.

| | |
|---|---|
| ***H01R 12/55*** | (2011.01) |
| ***H01R 12/79*** | (2011.01) |
| ***H01R 13/639*** | (2006.01) |
| ***H01R 12/88*** | (2011.01) |

(52) U.S. Cl.

CPC ..... *H01R 12/79* (2013.01); *H01R 12/88* (2013.01); *H01R 13/639* (2013.01)

(58) Field of Classification Search

CPC ..... H01R 12/79; H01R 12/88
USPC ..... 439/495
See application file for complete search history.

(56) References Cited

U.S. PATENT DOCUMENTS

| | | | | |
|---|---|---|---|---|
| 6,089,905 | A * | 7/2000 | Shimmyo | H01R 12/79 439/260 |
| 7,510,424 | B2 * | 3/2009 | Mundt | H01R 13/193 439/357 |
| 8,292,648 | B2 * | 10/2012 | Kiryu | H01R 13/6271 439/328 |
| 8,939,790 | B2 * | 1/2015 | Jung | H01R 13/62 439/495 |
| 10,566,721 | B2 * | 2/2020 | Nakajima | H01R 12/79 |
| 10,868,374 | B2 * | 12/2020 | Mizusawa | H01R 12/88 |
| 2019/0296488 | A1 * | 9/2019 | Nakajima | H01R 13/639 |

(Continued)

FOREIGN PATENT DOCUMENTS

JP 5809203 B2 11/2015

*Primary Examiner* — Neil Abrams
(74) *Attorney, Agent, or Firm* — Procopio, Cory, Hargreaves & Savitch LLP

(57) ABSTRACT

A movable member is provided at a flat conductor insertion location on one side in the connector thickness direction; at least either restricting portions or restricted protrusions have oblique surfaces rearwardly sloped toward the other side in the connector thickness direction; upon complete insertion of the flat conductor, engaging portions are positioned to be engageable with engaged portions in the direction of disengagement of the flat conductor at locations rearward of said engaged portions of the flat conductor; and, when a rearward disengagement force acts on the flat conductor upon complete insertion of said flat conductor, the engaged portions of the flat conductor engage the engaging portions and the restricted protrusions abut the restricting portions, as a result of which at least a reaction force directed toward the other side in the connector thickness direction is received from the restricting portions.

8 Claims, 9 Drawing Sheets

(56) References Cited

U.S. PATENT DOCUMENTS

| | | | | |
|---|---|---|---|---|
| 2020/0251842 | A1* | 8/2020 | Takane | H01R 12/774 |
| 2021/0111503 | A1* | 4/2021 | Mizusawa | H01R 12/88 |

* cited by examiner

ELECTRICAL CONNECTOR FOR FLAT CONDUCTORS

CROSS-REFERENCE TO RELATED APPLICATIONS

This application claims priority to Japanese Patent Application No. 2019-186768, filed Oct. 10, 2019, the contents of which are incorporated herein by reference in its entirety for all purposes.

BACKGROUND

Technical Field

This invention relates to an electrical connector for flat conductors, to which a flat conductor is connected.

Related Art

Known electrical connectors for flat conductors include, for example, a connector that has been disclosed in Patent Document 1. A connector, into and from which a flat conductor is inserted and removed such that the direction of insertion and removal is a forward-backward direction, i.e., a direction parallel to a mounting face of a circuit board, has been disclosed in Patent Document 1. Said connector has a housing extending such that its longitudinal direction is a direction perpendicular to the forward-backward direction, multiple terminals retained in the housing in array form such that the terminal array direction is said longitudinal direction, and a movable member supported in the housing such that it is capable of pivoting between a closed position and an open position, which are described below.

The housing, which has formed therein a rearwardly open receiving portion for receiving a flat conductor, has restricting portions used to accommodate the hereinafter-described restricted portions of the movable member formed as upwardly open recessed portions in its lateral walls located at opposite ends in the terminal array direction.

The movable member, which has a substantially plate-like configuration, is configured to be capable of pivoting between a closed position, which permits insertion of a flat conductor in an orientation substantially parallel to the mounting face of the circuit board and prevents disengagement after insertion, and an open position, which makes an angle to said mounting face and permits disengagement of the flat conductor. Said movable member has shaft portions that protrude outwardly in the terminal array direction at locations proximal to its rear end when it is located in the closed position and pivots about said shaft portions as a pivot center. In addition, said movable member has engaging arm portions that extend rearward in the closed position on the outer sides of the terminal array range in the terminal array direction. Said engaging arm portions have resilient arm portions that are resiliently displaceable in the up-down direction (where "up" is the direction away from the mounting face, and "down" is the direction toward it, each being perpendicular to said mounting face) in the closed position, engaging portions that protrude downwardly from the rear of said resilient arm portions, and restricted portions that protrude outwardly from the lateral faces of the engaging portions in the terminal array direction. In the closed position, engaged portions formed at the opposite lateral edges of the flat conductor can be engaged by the engaging portions from the rear. The front faces, i.e., the engaging faces of said engaging portions, lie in a plane perpendicular to the forward-backward direction.

In the connector of Patent Document 1, a flat conductor is forwardly inserted into the receiving portion of the housing when the movable member is located in the closed position, and, in the process of insertion, the flat conductor moves forward by abutting the engaging portions of the movable member with its front end and resiliently displacing the resilient arm portions upward. Upon complete insertion of said flat conductor, the engaging arm portions return to their unencumbered state and the engaging portions are positioned rearwardly of the engaged portions of the flat conductor so as to be engageable with the engaged portions using the front faces of said engaging portions (in a plane perpendicular to the forward-backward direction), thereby preventing inadvertent disengagement of said flat conductor. In addition, in the closed position, the restricted portions of the movable member are accommodated within the restricting portions of the housing and are positioned to be abuttable against the rear edge portions of said restricting portions (edge portions that extend in the up-down direction at locations rearward of the restricted portions) from the front. As a result, inadvertent disengagement of the flat conductor is more reliably prevented.

PATENT DOCUMENTS

[Patent Document 1]
Japanese Patent No. 5,809,203.

SUMMARY

Technical Problems to be Solved

In the connector of Patent Document 1, the engaged portions of the flat conductor engage the engaging portions of the movable member from the front and the restricted portions of the movable member abut the restricting portions of the housing from the front when the flat conductor is inadvertently pulled rearward upon complete insertion of the flat conductor, in other words, when the movable member is located in the closed position. If at such time the bottom ends of the engaging portions are worn out and oblique surfaces sloped downward toward the rear are formed on the front faces of said engaging portions by virtue of repeated engagement of said engaged portions with the engaging portions, a rearwardly directed component force and an upwardly directed component force are generated in the engaging portions when a force directed toward the rear of the flat conductor, i.e., a disengaging force, is received by the engaging portions on the oblique surfaces. As a result, the resilient arm portions may also be resiliently deformed upward by this upwardly directed component force and the engaged portions may move upward and become detached from the engaging portions. Furthermore, it is also conceivable that the flat conductor may be decoupled from the connector if the restricted portions also move upward and become detached from the restricting portions following the resilient deformation of the resilient arm portions.

In view of the aforesaid circumstances, it is an object of the present invention to provide an electrical connector for flat conductors capable of adequately preventing disengagement of a flat conductor from the connector.

Technical Solutions

It is an object of the present disclosure to provide an electrical connector for flat conductors in which disengagement of a flat conductor from the connector can be adequately prevented.

The inventive electrical connector for flat conductors, which is an electrical connector for flat conductors to which a flat conductor extending in a forward-backward direction is connected, and which is provided with a housing having formed therein a receiving portion as a space that is open at least rearwardly for the flat conductor to be forwardly inserted therein, multiple terminals retained in the housing in array form such that the terminal array direction is a direction perpendicular to the forward-backward direction, and a movable member that is provided at the flat conductor insertion location on one side in the connector thickness direction perpendicular to both the forward-backward direction and the terminal array direction and that can move between a closed position, which prevents disengagement of the flat conductor from the housing in an orientation along the forward-backward direction, and an open position, which permits disengagement of the flat conductor from the housing in a more angled orientation than the orientation in the closed position.

In the present invention, the electrical connector for flat conductors is characterized by the fact that the connector has restricting portions, which are formed as part of the housing or as members mounted to said housing and are capable of restricting movement of the movable member in the closed position, the movable member has engaging portions, which can engage engaged portions formed in the flat conductor in the direction of disengagement of said flat conductor at locations outward of the terminal array range in the terminal array direction, and restricted portions, which can abut the restricting portions in the direction of disengagement, at least either the restricting portions or the restricted portions have oblique surfaces rearwardly sloped toward the other side in the connector thickness direction, and, upon complete insertion of the flat conductor, the engaging portions are positioned to be engageable with said engaged portions in the direction of disengagement at locations rearward of the engaged portions of the flat conductor and, when a rearward disengagement force acts on the flat conductor upon complete insertion of said flat conductor, the engaged portions of the flat conductor engage the engaging portions and the restricted portions abut the restricting portions, as a result of which at least a reaction force directed toward the other side in the connector thickness direction is received from the restricting portions.

In the present invention, when a rearward disengagement force acts on the flat conductor upon complete insertion of said flat conductor, the engaged portions of the flat conductor engage the engaging portions of the movable member and the restricted portions of the movable member abut the restricting portions formed as part of the housing or as members mounted to the housing. Since at least either the restricting portions or the restricted portions have oblique surfaces sloped downward toward the rear, at least a reaction force directed toward the other side in the connector thickness direction is received by the engaged portions from the restricting portions. Therefore, even if the front faces (engaging faces) of the engaging portions of the movable member are worn out as a result of engagement with the engaged portions of the flat conductor, the restricting portions and, in turn, the engaging portions, will not move toward one side in the connector thickness direction even if the flat conductor is pulled rearward because a reaction force directed toward the other side is received by the restricted portions from the restricting portions. As a result, the state of abutment between the restricting portions and the restricted portions and the state of engagement between the engaging portions and the engaged portions are adequately maintained and inadvertent disengagement of the flat conductor is prevented.

In the present invention, the movable member has engaging arm portions at locations corresponding to the engaged portions of the flat conductor in the terminal array direction; the engaging arm portions have resilient arm portions, which extend in the forward-backward direction in the closed position and are resiliently displaceable in the connector thickness direction, engaging portions, and restricted portions; the engaging portions are formed protruding from the rear portion of the resilient arm portions toward the other side in the connector thickness direction; and the restricted portions may be either formed in the rear portion of the resilient arm portions, or formed protruding from the rear portion of said resilient arm portions in the terminal array direction.

In the present invention, the restricting portions and the restricted portions have the oblique surfaces, and said restricting and restricted portions may be adapted to come into surface-to-surface contact along the oblique surfaces when a rearward disengagement force acts on the flat conductor upon complete insertion of said flat conductor. The surface-to-surface contact between the restricting portions and the restricted portions along the oblique surfaces can ensure a large surface area for possible abutment between the restricting portions and the restricted portions, and can bring them into abutment in a more reliable manner. As a result, a reaction force from the restricting portions directed toward the other side in the connector thickness direction is likely to act on the restricted portions.

In the present invention, the restricted portions may be formed at the same locations as the engaging portions in the terminal array direction.

Technical Effects

In the present invention, at least either the restricting portions or the restricted portions have oblique surfaces sloped downward toward the rear and, when a rearward disengagement force acts on the flat conductor upon complete insertion of said flat conductor, movement of the restricting portions and, in turn, the engaging portions, toward one side in the connector thickness direction is minimized due to the fact that at least a reaction force directed toward the other side in the connector thickness direction is received by the restricted portions from the restricting portions by virtue of abutment of the restricted portions against the restricting portions. Therefore, the state of abutment between the restricting portions and the restricted portions and the state of engagement between the engaging portions and the engaged portions are adequately maintained and inadvertent disengagement of the flat conductor is prevented.

BRIEF DESCRIPTION OF DRAWINGS

FIGS. 4(A) to 4(C) are vertical cross-sectional views illustrating connector cross-sections prior to the insertion of the flat conductor, in which FIG. 4(A) is a view at the location of the second terminals, FIG. 4(B) is a view at the location of the engaging arm portions of the movable member, and FIG. 4(C) is a view at the location of the restricted portions of the movable member.

FIGS. 5(A) to 5(C) are vertical cross-sectional views illustrating connector cross-sections after flat conductor insertion, in which FIG. 5(A) is a view at the location of the second terminals, FIG. 5(B) is a view at the location of the engaging arm portions of the movable member, and FIG. 5(C) is a view at the location of the restricted portions of the movable member.

FIGS. 6(A) to 6(C) are vertical cross-sectional views illustrating connector cross-sections obtained when the flat conductor is pulled rearward after flat conductor insertion, in which FIG. 6(A) is a view at the location of the second terminals, FIG. 6(B) is a view at the location of the engaging arm portions of the movable member, and FIG. 6(C) is a view at the location of the restricted portions of the movable member.

FIGS. 7(A) to 7(C) are vertical cross-sectional views illustrating connector cross-sections obtained when the flat conductor is pulled further rearward in the state of FIGS. 6(A) to 6(C), in which FIG. 7(A) is a view at the location of the second terminals, FIG. 7(B) is a view at the location of the engaging arm portions of the movable member, and FIG. 7(C) is a view at the location of the restricted portions of the movable member.

FIGS. 8(A) to 8(C) are vertical cross-sectional views illustrating connector cross-sections immediately prior to flat conductor disengagement, in which FIG. 8(A) is a view at the location of the second terminals, FIG. 8(B) is a view at the location of the engaging arm portions of the movable member, and FIG. 8(C) is a view at the location of the restricted portions of the movable member.

FIGS. 9(A) to 9(C) are vertical cross-sectional views illustrating cross-sections taken at the location of the engaging arm portions of the movable member in a second embodiment of the present invention, in which FIG. 9(A) is a view obtained after flat conductor insertion, FIG. 9(B) is a view obtained when the flat conductor is pulled rearward in the state of FIG. 9(A), and FIG. 9(C) is a view obtained when the flat conductor is pulled further rearward in the state of FIG. 9(B).

DETAILED DESCRIPTION

The embodiments of the invention are described below with reference to the accompanying drawings.

First Embodiment

Figure 1:
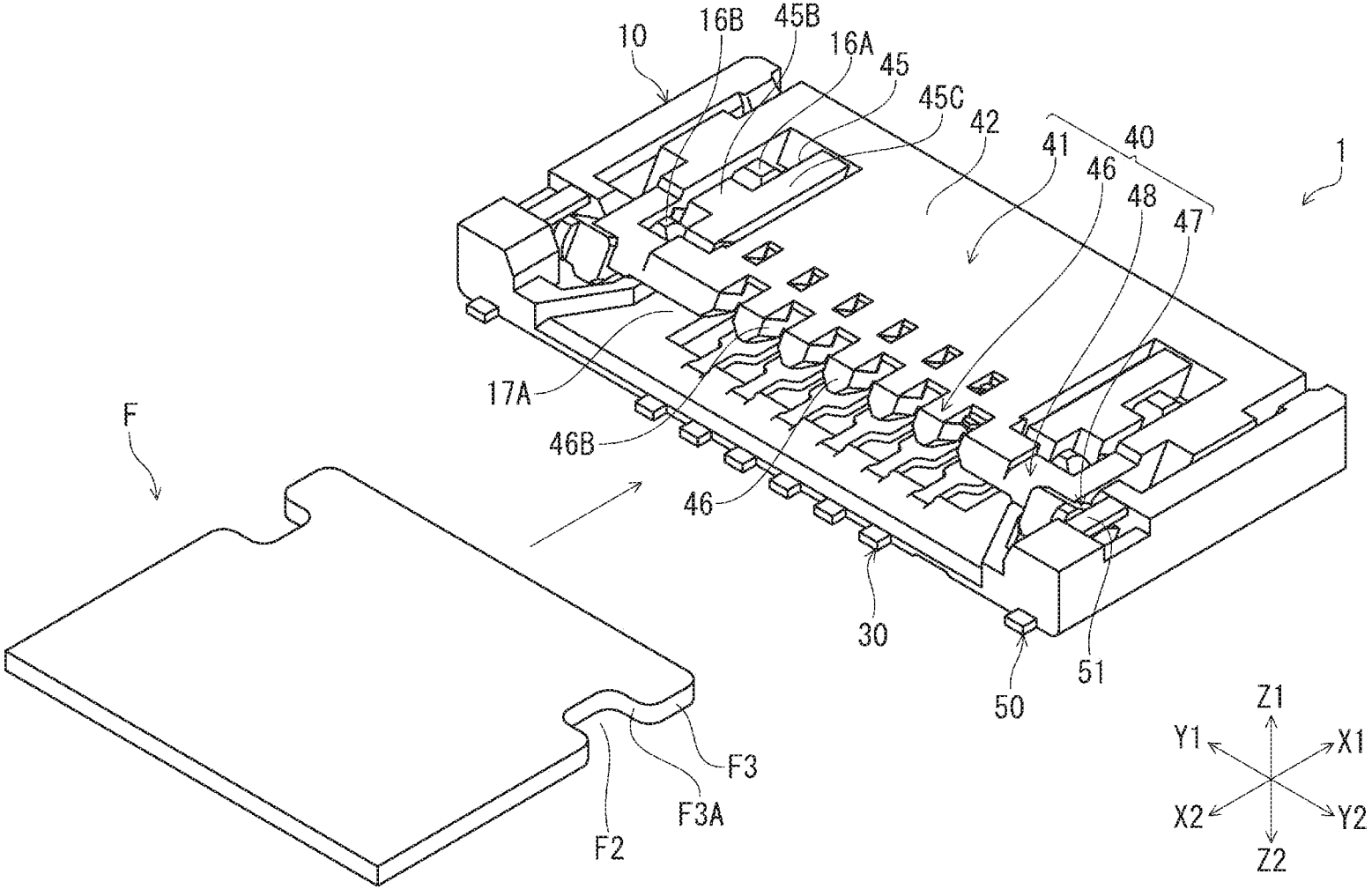
FIG. 1 is a perspective view illustrating the connector according to the first embodiment of the invention along with the flat conductor prior to insertion.

FIG. 1 is a perspective view illustrating an electrical connector for flat conductors 1 according to the present embodiment (referred to as "connector 1" hereinbelow) along with a flat conductor F. The connector 1 is mounted to the mounting face of a circuit board (not shown), and the flat conductor F is adapted to be connected thereto in a manner permitting insertion and removal such that the direction of insertion and removal is a forward-backward direction parallel to said mounting face (X-axis direction). Said connector 1 puts the circuit board and the flat conductor F in electrical communication when the flat conductor F is connected thereto. In the present embodiment, X1 is the forward direction and X2 is the rearward direction along the X-axis direction (forward-backward direction). In addition, the Y-axis direction, which is perpendicular to the forward-backward direction (X-axis direction) in a plane (XY plane) parallel to the mounting face of the circuit board, is the connector width direction, and the Z-axis direction (up-down direction), which is perpendicular to the mounting face of the circuit board, is the connector thickness direction.

The flat conductor F, which extends in the forward-backward direction (X-axis direction) in the form of a strip whose width direction is the connector width direction (Y-axis direction), has multiple circuits (not shown) that extend in the forward-backward direction formed in an array in the connector width direction. This circuitry, which is embedded within an insulating layer in the flat conductor F, extends in the forward-backward direction and reaches the location of the front end of the flat conductor F. In addition, only the front end section of the above-mentioned circuitry is exposed on the top face of the flat conductor F and can contact first terminals 20 and second terminals 30 in the hereinafter-described connector 1.

Further, the flat conductor F has notched portions F2 formed at the opposite lateral edges of the front end section, and the rear end edges of the ears F3 positioned forwardly of said notched portions F2 function as engaged portions F3A engageable using the hereinafter-described engaging portions 45A of the connector 1 (see FIG. 5(B), FIG. 6(B), and FIG. 7(B)).

The connector 1 includes: a housing 10 made of an electrically insulating material, multiple metal first terminals 20 and second terminals 30 retained in said housing 10 in array form via unitary co-molding (see FIG. 2), a movable member 40 made of an electrically insulating material and capable of pivoting relative to the housing 10 between the hereinafter-described closed and open positions, and fittings 50 retained in the housing 10 via unitary co-molding, and the flat conductor F is adapted to be inserted and connected thereto from the rear. Below, when there is no need to distinguish between the first terminals 20 and the second terminals 30, these two kinds of terminals are collectively referred to as the "terminals 20, 30".

A summary of the operations of insertion and disengagement of the flat conductor F into and from the connector 1 will be provided prior to explaining the configuration of the connector 1 in detail. The movable member 40 of the connector 1 is enabled for pivotal movement between a closed position, in which insertion of the flat conductor F is permitted and, at the same time, its disengagement is prevented, and an open position, in which disengagement of the flat conductor F is permitted. As shown in FIG. 1, prior to insertion of the flat conductor F into the connector 1, the movable member 40 of the connector 1 is positioned in the closed position while being oriented parallel to the mounting face of the circuit board (not shown) and the housing 10 along the forward-backward direction. The flat conductor F, with its front end edge, abuts the terminals 20, 30 and causes the abutting sections of said terminals 20, 30 to be resiliently displaced, thereby allowing for insertion to a predetermined position (normal insertion position).

Upon insertion and connection of the flat conductor F, when the connector 1 is in use, the movable member 40 is maintained in the closed position and, as discussed below, the engaging portions 45A of the movable member 40 and the engaged portions F3A of the flat conductor F are positioned to be engageable, thereby preventing rearward movement (in the X2 direction) of the flat conductor F and preventing inadvertent disengagement of the flat conductor F (see FIG. 5(B), FIG. 6(B), and FIG. 7(B)). In addition, when the flat conductor F is disengaged, i.e., when the connector 1 is not used, the movable member 40 is pivoted and brought into the open position in which it is disposed in an upstanding orientation more angled than the orientation in the closed position (see FIGS. 8(A) to 8(C)), thereby breaking the engagement of the engaging portions 45A of the movable member 40 with the engaged portions F3A of the flat conductor F and allowing for rearward movement of the flat conductor F, that is, disengagement of the flat conductor F. In the present embodiment, the angle of pivoting of the movable member 40 from the closed position to the open position is approximately 90 degrees.

Although in the present embodiment the movable member 40 is adapted for movement between the closed position and the open position by pivoting about a pivoting axis that extends in the connector width direction, the way the movable member 40 moves is not limited to the above and, for example, may involve pivoting accompanied by a sliding motion.

Figure 2:
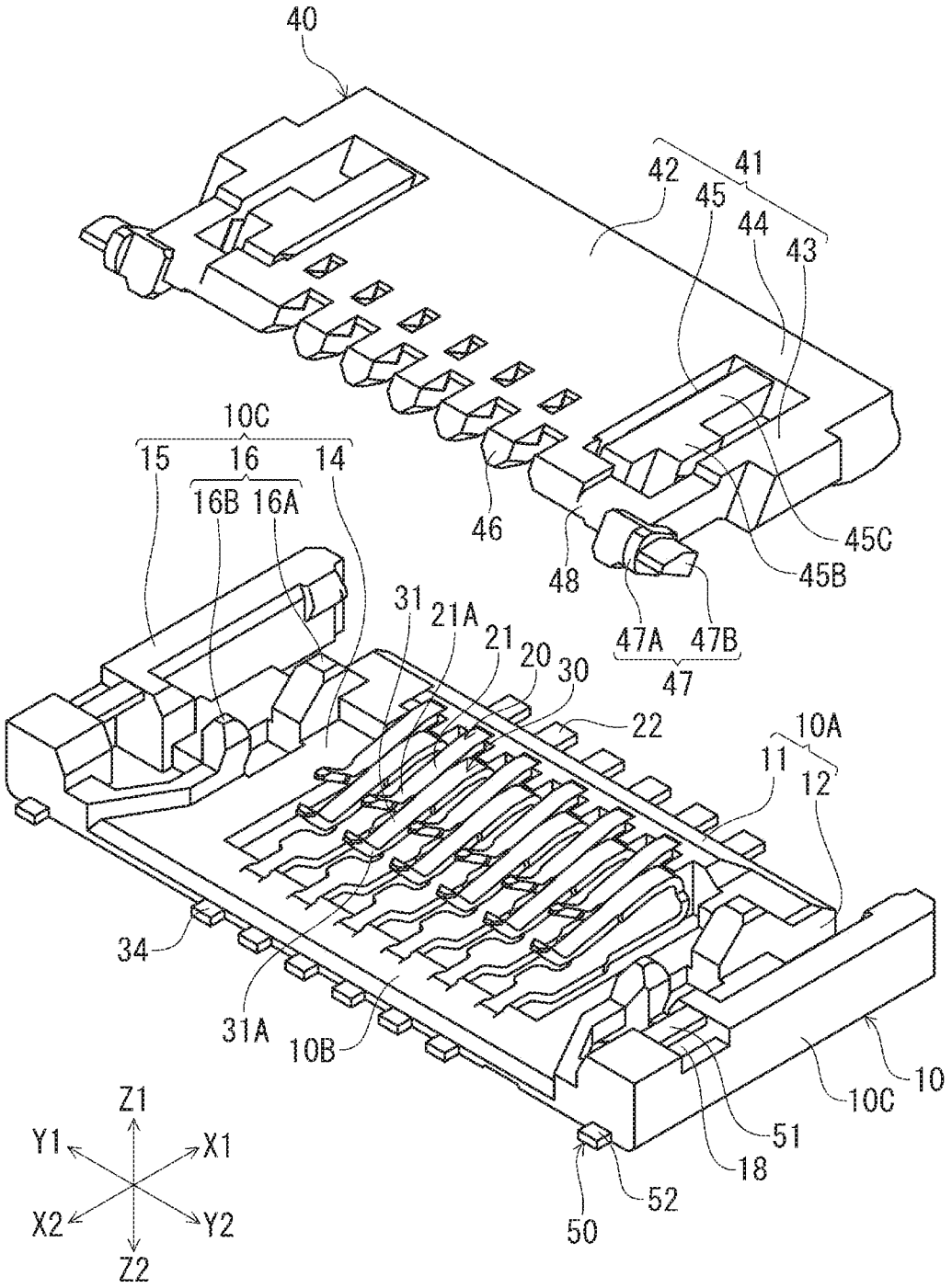
FIG. 2 is a perspective view illustrating the connector of FIG. 1, in which the movable member is shown separated in the upward direction.
Figure 3:
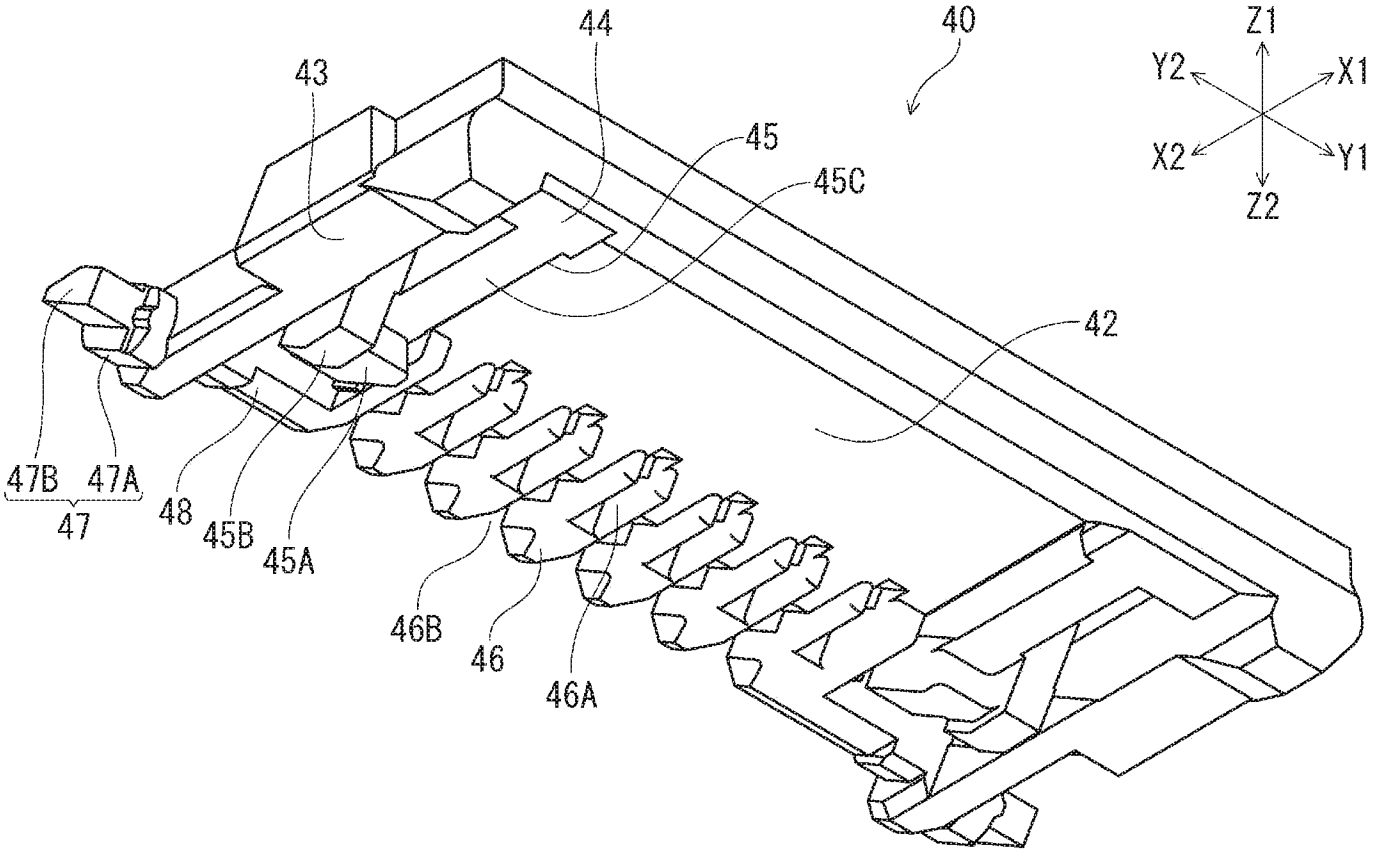
FIG. 3 is a perspective view of the movable member of FIG. 2 as viewed from the front and from below.
Figure 4A:
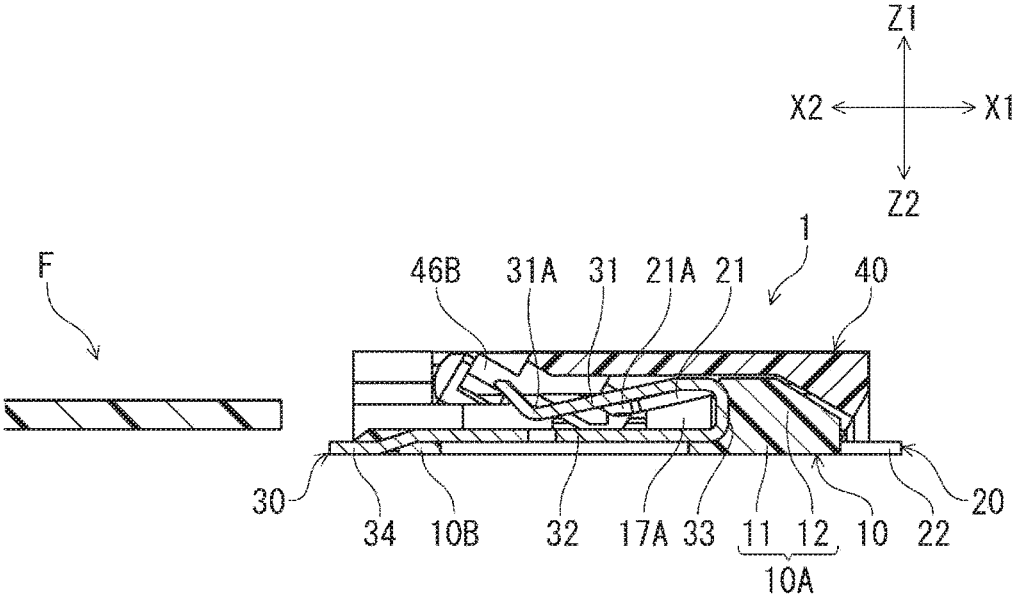
Figure 4B:
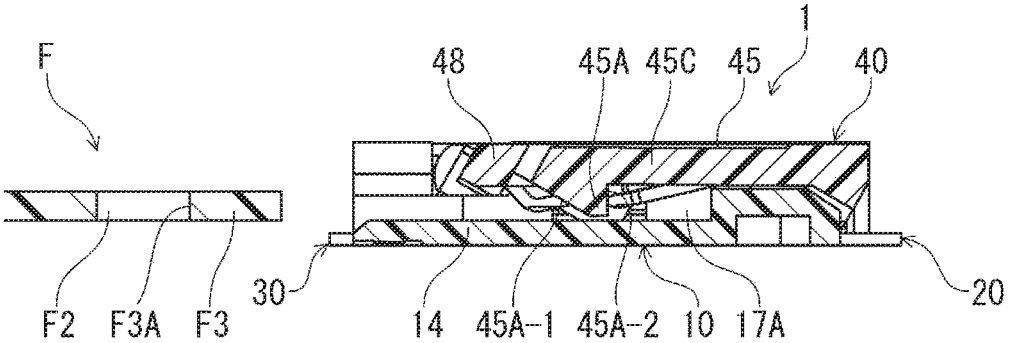
Figure 4C:
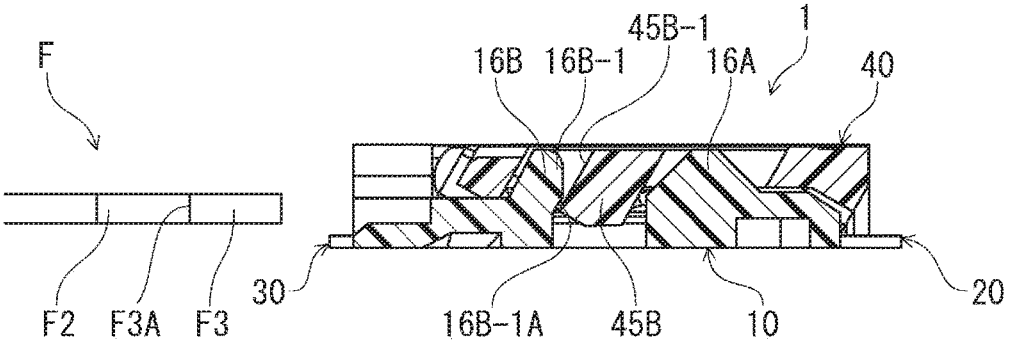

Going back to the configuration of the connector 1, FIG. 2 is a perspective view illustrating the connector of FIG. 1, in which the movable member 40, disposed in the orientation of the closed position, is shown separated from the housing 10 in the upward direction. FIG. 3 is a perspective view of the movable member 40 of FIG. 2 as viewed from the front and from below. FIGS. 4(A) to 4(C) shows vertical cross-sectional views illustrating connector cross-sections prior to the insertion of the flat conductor, in which FIG. 4(A) is a view at the location of the second terminals 30, FIG. 4(B) is a view at the location of the engaging arm portions 45 of the movable member 40, and FIG. 4(C) is a view at the location of the restricted protrusions 45B serving as the restricted portions of the movable member.

As shown in FIG. 2, the housing 10, when viewed from above, is of a square frame-like shape, whose longitudinal direction is the connector width direction (Y-axis direction), and has a front frame portion 10A and a rear frame portion 10B, which are parallel to each other and extend in the connector width direction, and a pair of lateral frame portions 10C, which are positioned symmetrically in the connector width direction and extend in the forward-backward direction while coupling the ends of the front frame portion 10A and the rear frame portion 10B.

As can be seen in FIG. 2, the front frame portion 10A has a front base portion 11, which forms the bottom portion facing the circuit board (not shown) and extends across the terminal array range in the connector width direction, and a front wall 12, which rises upwardly from said front base portion 11 and is formed across the terminal array range in the connector width direction (see FIG. 4(A)). The front base portion 11 and the front wall 12 of the front frame portion 10A have first terminals 20 and second terminals 30 retained in array form via unitary co-molding. The top face of the front wall 12, which faces and is abuttable against the bottom face of the movable member 40 in the closed position (see FIG. 4(A)), is adapted to restrict excessive downward displacement of the movable member 40. The rear frame portion 10B extends across the terminal array range in the connector width direction and has the second terminals 30 retained in array form via unitary co-molding in cooperation with the front frame portion 10A.

As can be seen in FIG. 2, the lateral frame portions 10C have plate-shaped lateral base portions 14, which couple the ends of the front base portion 11 and the rear frame portion 10B in the connector width direction, lateral walls 15, which are positioned outwardly of said lateral base portions 14 in the connector width direction and are coupled to said lateral base portions 14, and lateral protruding portions 16, which are positioned inwardly of said lateral walls 15 in the connector width direction (proximal to the terminal array range) and protrude upwardly from the lateral base portions 14.

As can be seen in FIG. 1 and FIG. 2, the lateral walls 15 have their substantially rear-half portions protruding farther inward in the connector width direction than other portions, and, as discussed below, shaft holding portions 18 used to accommodate the hereinafter-described second outer shaft portions 47B of the movable member 40 are formed in the intermediate area in the forward-backward direction of said substantially rear-half portions such that they extend through in the up-down direction and are inwardly open in the connector width direction.

As can be seen in FIG. 2, the lateral protruding portions 16 have front restricting protrusions 16A, which are positioned proximal to the front ends of the lateral base portions 14, and rear restricting protrusions 16B, which are positioned rearwardly of said front restricting protrusion 16A. As can be seen in FIG. 4(C), the hereinafter-described restricted protrusions 45B of the movable member 40 are adapted to be accommodated within the space between the front restricting protrusions 16A and the rear restricting protrusions 16B when said movable member 40 is brought into the closed position. In the closed position, the front restricting protrusions 16A can restrict forward movement of the restricted protrusions 45B with their rear faces. In addition, as can be seen in FIG. 4(C), the rear restricting protrusions 16B have restricting portions 16B-1 that protrude forwardly toward the above-mentioned space. The front faces of the lower portions of said restricting portions 16B-1 have formed thereon restricting faces 16B-1A sloped downward toward the rear. As discussed below, the restricting portions 16B-1 can restrict the rearward movement and pivoting toward the open position of the movable member 40 in the closed position by abutting against the restricted protrusions 45B of the movable member 40 with the restricting faces 16B-1A.

As can be seen in FIG. 2, shaft holding portions 18, which accommodate the hereinafter-described second outer shaft portions 47B, are formed at the rear ends (on side X2) of the lateral walls 15 within a range that comprises said second outer shaft portions 47B of the movable member 40 when the housing 10 is viewed in the up-down direction (Z-axis direction). As discussed above, said shaft holding portions 18 are formed as spaces that extend in the up-down direction through the intermediate areas in the forward-backward direction of said substantially rear-half portions of the lateral walls 15 and are inwardly open in the connector width direction.

Figure 8A:
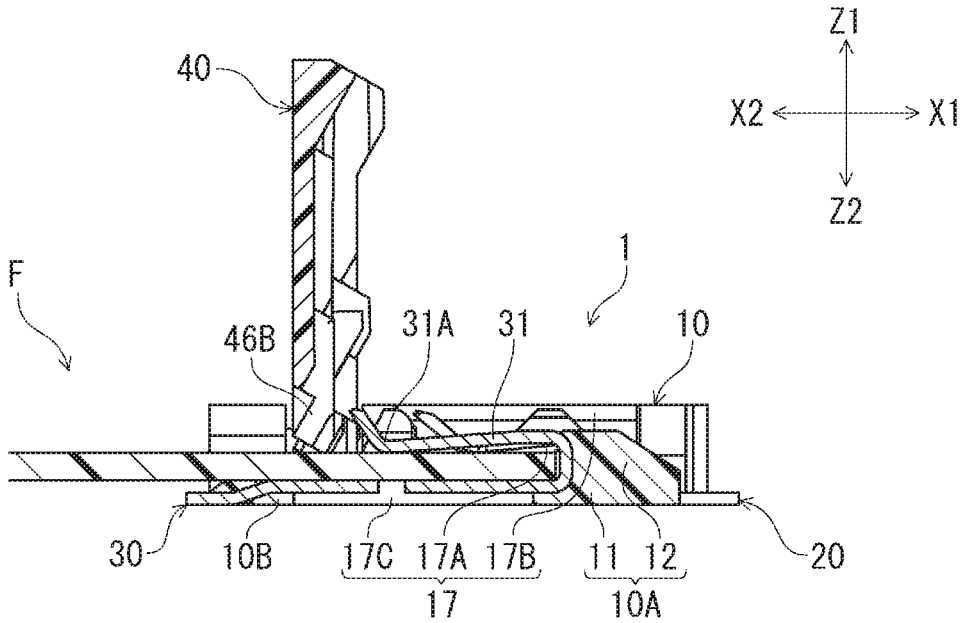

A space 17, which has a receiving portion 17A, a recessed holding portion 17B, and a bottom opening 17C, is formed in the housing 10 (see also FIG. 8(A)). Namely, as can be seen with reference to FIG. 8(A), the space 17 has a receiving portion 17A, which is used for receiving the forwardly inserted flat conductor F, a recessed holding portion 17B, which is positioned above said receiving portion 17A and is used to accommodate the movable member 40 in the closed position, and a bottom opening 17C, which is positioned under the receiving portion 17A.

The receiving portion 17A, which is positioned above the rear frame portion 10B and under the hereinafter-described cover plate portion 42 of the movable member 40 in the closed position in the up-down direction (Z-axis direction), extends from the rear end of the connector 1 to the rear face of front wall 12 of the housing 10 in the forward-backward direction (X-axis direction) and is formed across the space between the two lateral protruding portions 16 in the connector width direction (Y-axis direction). Said receiving portion 17A, which is open rearwardly as well as upwardly, allows for the front end section of the flat conductor F to be received therein from the rear. In addition, due to the fact that said receiving portion 17A is open not only rearwardly but also upwardly, the flat conductor F can be received in the rear portion of said receiving portion 17A even in an oblique orientation.

The recessed holding portion 17B, which is positioned above the receiving portion 17A in communication with said receiving portion 17A, is formed between the two lateral walls 15 in the connector width direction. Said recessed holding portion 17B is upwardly open and can accommodate the movable member 40 when it is brought into the closed position. The recessed holding portion 17B is formed extending from the vicinity of the rear ends of the second contact arm portions 31 of the hereinafter-described second terminals 30 to the front end of the housing 10 in the forward-backward direction. While in the present embodiment the recessed holding portion 17B is assumed to be positioned above the receiving portion 17A, the phrase "positioned above" also includes situations in which the recessed holding portion 17B is formed so as to partially overlap with the receiving portion 17A in the up-down direction.

In addition, the bottom opening 17C is formed as a space that extends through in the up-down direction while being surrounded by the square frame-shaped section of the housing 10 (section made up of the front frame portion 10A, rear frame portion 10B, and lateral frame portions 10C).

In the present embodiment, the terminals are made up of two types of terminals of different shapes, i.e., the first terminals 20 and the second terminals 30. As can be seen in FIG. 2, the first terminals 20 and the second terminals 30 are arranged in an alternating manner such that the terminal array direction is the connector width direction.

As can be seen in FIG. 2, the first terminals 20 are fabricated by bending strips of rolled sheet metal, whose dimension in the connector width direction (Y-axis direction) is the terminal width direction, in the through-thickness direction. The first terminals 20 are of a substantially cranked shape as a whole and have first contact arm portions 21, which extend in the forward-backward direction (X-axis direction) and are resiliently displaceable in the up-down direction (Z-axis direction), first connecting portions 22, which are positioned below said first contact arm portions 21 and extend forward, and first coupling portions (not shown), which extend in the up-down direction and couple the front ends of the first contact arm portions 21 and the rear ends of the first connecting portions 22.

The first contact arm portions 21, which extend at a slight downward incline toward the rear, have first contact portions 21A formed in a curved shape protruding downward at locations proximal to their rear ends. When the flat conductor F is inserted into the connector 1, said first contact portions 21A can be brought into contact with the corresponding circuits of the flat conductor F by virtue of upwardly directed resilient displacement of the first contact arm portions 21.

The first connecting portions 22, which have their front end sections forwardly projecting from the front frame portion 10A of the housing 10, are adapted to have their bottom faces solder-connected to circuitry on the circuit board (not shown). In addition, the first coupling portions (not shown) and the sections proximal to the rear ends of the first connecting portions 22 are retained by the front frame portion 10A of the housing 10 via unitary co-molding.

As can be seen in FIG. 2, just like the first terminals 20, the second terminals 30 are fabricated by bending strips of rolled sheet metal, whose dimension in the connector width direction is the terminal width direction, in the through-thickness direction, and have formed therein second contact arm portions 31 that extend in the forward-backward direction and are resiliently displaceable in the up-down direction, retained arm portions 32 that extend in the forward-backward direction at locations under said second contact arm portions 31 and are retained by the housing 10 at the front and rear end portions, curved second coupling portions 33 that extend in the up-down direction and couple the front ends of the retained arm portions 32 and the second contact arm portions 31, and second connecting portions 34 that extend rearward from said retained arm portions 32.

By virtue of being provided with the second contact arm portions 31, the retained arm portions 32, and the second coupling portions 33, the second terminals 30 have formed therein recumbent U-shaped sections open in a rearward direction (in the X2 direction) (see also FIG. 4(A)) and, as discussed below, are capable of receiving the flat conductor F within said recumbent U-shaped sections from the rear. At the same time, due to the fact that the second contact arm portions 31 are resiliently displaced when receiving the flat conductor F, the flat conductor F can be clamped by said second contact arm portions 31 and the retained arm portions 32.

As can be seen in FIG. 4(A), the second contact arm portions 31, which extend from the top ends of the second coupling portions 33 toward the rear at a slight downward incline, have second contact portions 31A formed in a curved shape protruding downward at locations proximal to their rear ends. The second contact portions 31A, which are positioned rearwardly of the first contact portions 21A of the first terminals 20, are adapted to be connected to the corresponding circuits of the flat conductor F.

The retained arm portions 32 extend rearward from the bottom ends of the second coupling portions 33 in parallel to the second contact arm portions 31 all the way to the location of the rear frame portion 10B of the housing 10. The sections proximal to the rear ends of said retained arm portions 32 are retained by the rear frame portion 10B of the housing 10 via unitary co-molding. In addition, the second coupling portions 33 and sections proximal to the front ends of said retained arm portions 32 are retained by the front frame portion 10A via unitary co-molding. In other words, as can be seen in FIG. 4(A), the retained arm portions 32 are retained by the housing 10 in a doubly supported beam configuration.

The second connecting portions 34, which rearwardly project from the rear frame portion 10B, as can be seen in FIG. 4(A), are adapted to have its bottom faces solder-connected to circuitry on the circuit board (not shown).

As can be seen in FIG. 1, in which the movable member 40 is illustrated in the orientation of the closed position, said movable member 40 has a substantially plate-like main body portion 41 that extends in the forward-backward direction (X-axis direction) and in the connector width direction (Y-axis direction), projections 46 formed at the rear end (on side X2) of the main body portion 41, which is shown in a state obtained when the movable member 40 is in the closed position, outer shaft portions 47, and inner shaft portions 48.

As can be seen in FIG. 2, the main body portion 41 has a cover plate portion 42 that extends across the terminal array range in the connector width direction and that covers the terminals 20, 30 from above in the closed position (see also FIG. 1 and FIG. 3), terminal arm portions 43 that extend rearward in outward positions on opposite sides of said cover plate portion 42, linking portions 44 that link the front ends of the terminal arm portions 43 and the cover plate portion 42, and engaging arm portions 45 that extend rearward from the linking portions 44 in a cantilever configuration.

As can be seen in FIG. 2, when the movable member 40 is in the orientation of the closed position, the rear end portions (bottom end portions in the open position) of the terminal arm portions 43 couple the outer shaft portions 47 and the inner shaft portions 48.

As can be seen in FIG. 4(B), in which the movable member 40 is in the closed position, the engaging arm portions 45 have resilient arm portions 45C that extend in the forward-backward direction and are resiliently displaceable in the up-down direction, engaging portions 45A that protrude downwardly from the rear end portions of said resilient arm portions 45C, and restricted protrusions 45B that protrude outwardly in the terminal array direction from the engaging portions 45A and said resilient arm portions 45C at locations proximal to the rear ends of the resilient arm portions 45C (see also FIG. 3). As shown in FIG. 4(B), when the movable member 40 is in the closed position, said engaging portions 45A are push-fitted into the receiving portion 17A of the housing 10 from above. In addition, as shown in FIG. 4(B), in the rear portion, said engaging portions 45A have guide faces 45A-1 used for guiding the flat conductor F forwardly in the process of insertion of said flat conductor F when the movable member 40 is in the closed position, and, in the front portion, have engaging faces 45A-2 engageable from the rear with the engaged portions F3A formed in said flat conductor F after insertion of the flat conductor F (see also FIG. 5(B)).

As can be seen in FIG. 4(B), when the movable member 40 is in the closed position, the guide faces 45A-1 form oblique surfaces sloped downward toward the front. When the front end portions of the ears F3 abut the guide faces 45A-1 in the process of insertion of the flat conductor F, the resilient arm portions 45C are readily resiliently displaced in the upward direction under the abutment force.

In addition, as can be seen in FIG. 4(B), when the movable member 40 is in the closed position, the engaging faces 45A-2, extend in the up-down direction without tilting when viewed in the connector width direction. In other words, said engaging faces 45A-2 form surfaces perpendicular to the forward-backward direction in the closed position. Therefore, in the closed position, the engaging faces 45A-2 are positioned rearwardly of the engaged portions F3A of the flat conductor F and can prevent inadvertent disengagement of the flat conductor F by reliably engaging said engaged portions F3A from the rear.

As can be seen in FIG. 4(C), the front and rear faces of the restricted protrusions 45B are oblique surfaces sloped downward toward the rear in the same orientation and at the same angle as the restricting faces 16B-1A of the restricting portions 16B-1 of the housing 10. When the movable member 40 is brought into the closed position, said restricted protrusions 45B are adapted to enter the space between the front restricting protrusions 16A and the rear restricting protrusions 16B of the housing 10 and be positioned to be abuttable against said front restricting protrusions 16A from the rear, thereby restricting their forward movement. In addition, the rear faces of said restricted protrusions 45B are formed as restricted faces 45B-1 that can abut the restricting faces 16B-1A by coming into surface-to-surface contact therewith. When the movable member 40 is in the closed position, said restricted faces 45B-1 are in surface-to-surface contact with restricting faces 16B-1A, thereby restricting pivoting to the open position and rearward movement of the movable member 40. In addition, said restricted protrusions 45B, which are formed within a range that includes part of the engaging portions 45A when viewed in the connector width direction, also serve to reinforce the strength of said engaging portions 45A.

Multiple projections 46 are formed at spaced intervals at locations corresponding to the first terminals 20 in the connector width direction, and, as can be seen in FIGS. 1 to 3, protrude from the bottom face of the rear end portion of the cover plate portion 42 and extend in the rearward direction when the movable member 40 is in the closed position. As can be seen in FIG. 3, each projection 46 has formed therein a first groove portion 46A made by recessing the bottom face (surface proximal to the receiving portion 17A) of roughly the front half of said projection 46 in the closed position. Said first groove portions 46A, which are formed at locations corresponding to the rear ends of the first contact arm portions 21 of the first terminals 20 in the connector width direction and in the forward-backward direction when the movable member 40 is in the closed position, accommodate the rear ends of said first contact arm portions 21 in said closed position.

As can be seen in FIGS. 1 to 3, second groove portions 46B that extend across the entire extent of the projections 46 in the forward-backward direction in the closed position are formed between mutually adjacent projections 46, in other words, at locations corresponding to the rear ends of the second contact arm portions 31 of the second terminals 30 in the connector width direction (see also FIG. 4(A)). As can be seen in FIG. 4(A), said second groove portions 46B are adapted to accommodate the rear ends of the second contact arm portions 31 when the movable member 40 is brought into the closed position.

As can be seen in FIG. 2 and FIG. 3, the outer shaft portions 47 of the movable member 40, whose exterior peripheral surface around the pivoting axis is a non-cylindrical surface, have first outer shaft portions 47A, which extend outwardly in the connector width direction from the exterior surfaces of the rear end portions of the terminal arm portions 43 in the closed position, and second outer shaft portions 47B, which are thinner than said first outer shaft portions 47A and extend outwardly from said first outer shaft portions 47A in the connector width direction.

Of the first outer shaft portions 47A and second outer shaft portions 47B of the outer shaft portions 47, the second outer shaft portions 47B are accommodated within the shaft holding portions 18 of the housing 10. The second outer shaft portions 47B, which are positioned within the shaft holding portions 18 under the hereinafter-described movement restricting portions 51 of the fittings 50, are adapted to have their upwardly directed movement in excess of a predetermined amount restricted by said movement restricting portions 51.

When the movable member 40 is in the closed position, the inner shaft portions 48 are positioned rearwardly of the engaging arm portions 45 within a range comprising said engaging arm portions 45 in the connector width direction, and couple the rear end portions of the terminal arm portions 43 and the projections 46 that are positioned most outwardly in the connector width direction. The exterior peripheral surface around the pivoting axis of said inner shaft portions 48 is a non-cylindrical surface.

As can be seen in FIG. 2, the fittings 50 are retained by the lateral walls 15 of the housing 10 via unitary co-molding at locations corresponding to the second outer shaft portions 47B of the movable member 40 and the shaft holding portions 18 of the housing 10 in the connector width direction. Said fittings 50 are formed by bending strips of rolled sheet metal in the through-thickness direction and are retained in the lateral walls 15 in an orientation in which their rolled faces (major faces) are parallel to the connector width direction.

The fittings 50 have movement restricting portions 51 that extend in the forward-backward direction, front retained portions (not shown) that are bent so as to extend downward at the front ends of said movement restricting portions 51 and are retained in the housing 10, rear retained portions (not shown) that extend from the rear ends of said movement restricting portions 51 in a crank-like configuration and are retained in the housing 10, and fastening portions 52 that project rearwardly from said rear retained portions out of the housing 10.

Figure 6A:
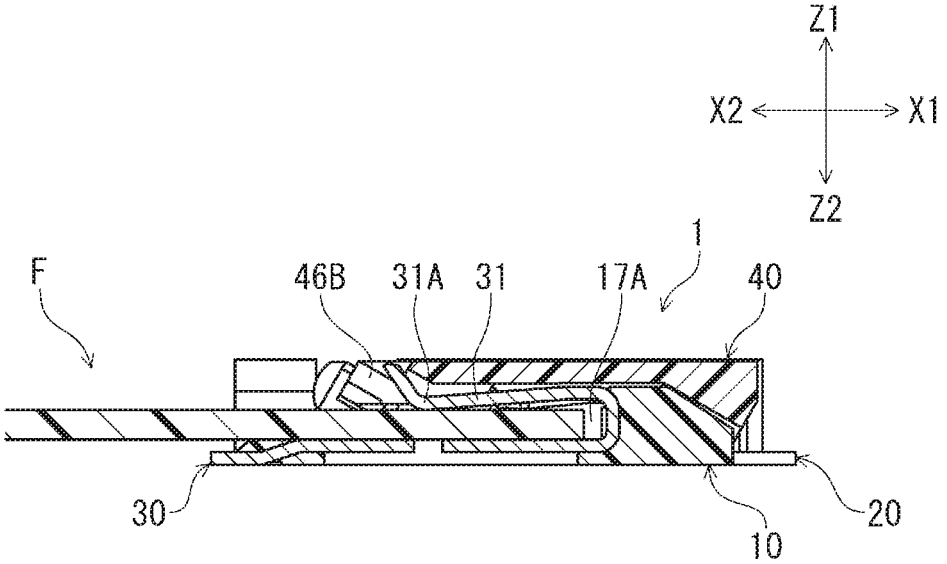
Figure 6B:
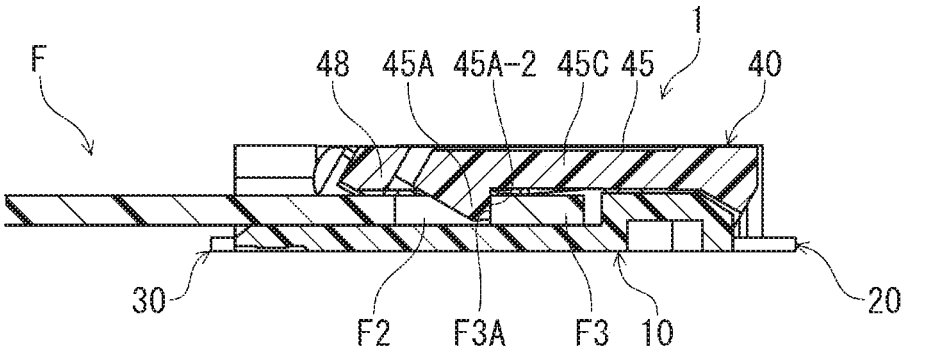
Figure 6C:
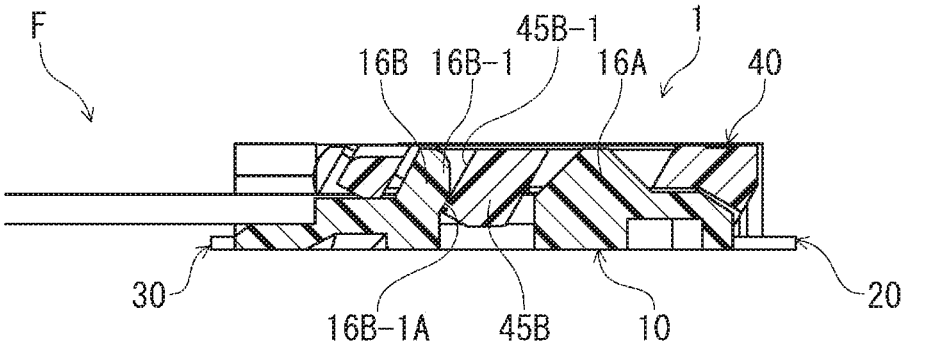
Figure 7A:
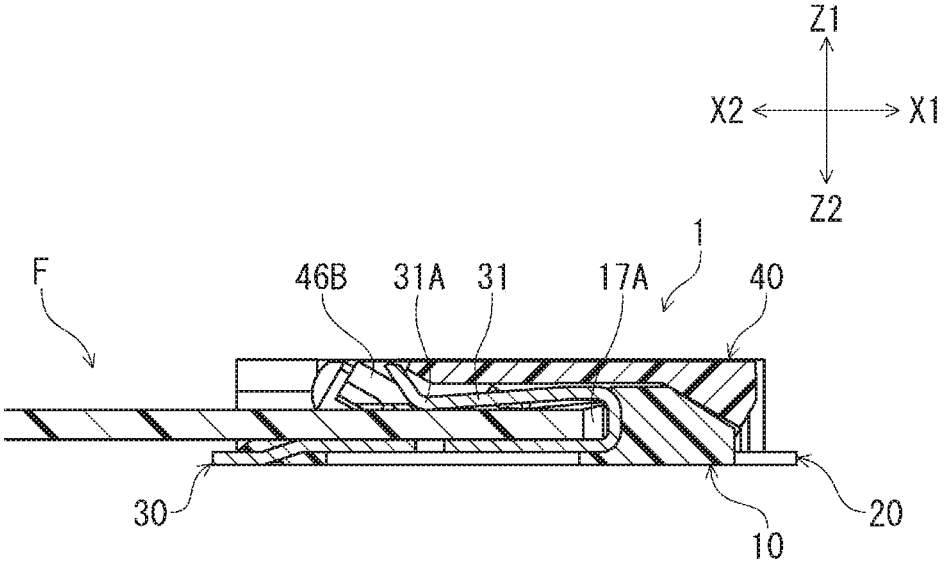
Figure 7B:
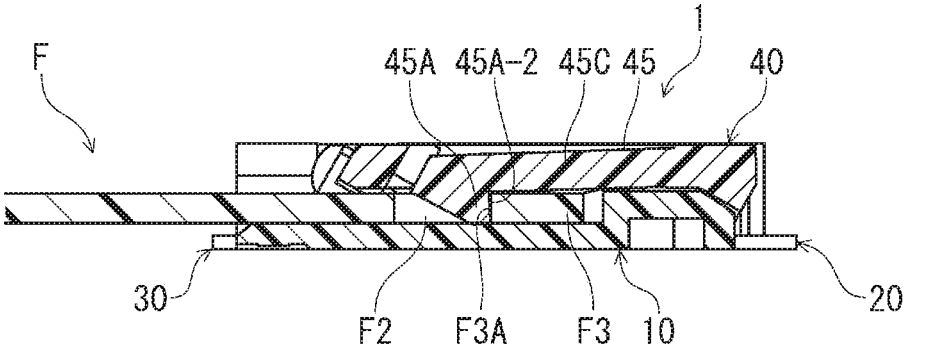
Figure 7C:
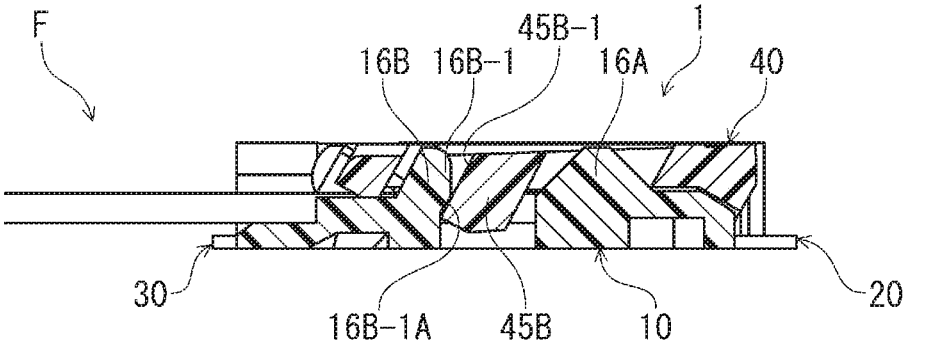

As can be seen in FIG. 6(C) and FIG. 7(C), the movement restricting portions 51 are positioned within said shaft holding portions 18 of the housing 10 and extend in the forward-backward direction at locations proximal to the top ends of the lateral walls 15. Said movement restricting portions 51 are located upwardly of the second outer shaft portions 47B of the movable member 40 and the bottom faces (major faces) of the movement restricting portions 51 are opposed so as to be abuttable against the second outer shaft portions 47B, as a result of which upward disengagement of the movable member 40 from the housing 10 is prevented.

The fastening portions 52 project rearwardly from the lateral walls 15 in a rectilinear configuration. As can be seen in FIG. 2, the bottom faces of said fastening portions 52 are positioned at substantially the same level as the bottom face of the housing 10 and are adapted to be secured to corresponding portions on the mounting face of the circuit board via solder attachment.

The operation of connecting the connector 1 and the flat conductor F will be described next with reference to FIG. 4(A) to FIG. 8(C).

First, the first connecting portions 22 of the first terminals 20 and the second connecting portions 34 of the second terminals 30 of the connector 1 are solder-connected to the corresponding circuits of the circuit board (not shown) and the fastening portions 52 of the fittings 50 are solder-connected to the corresponding portions of the circuit board. The connector 1 is mounted to the circuit board via solder attachment of said first connecting portions 22, said second connecting portions 34, and said fastening portions 52.

Next, as illustrated in FIGS. 4(A) to 4(C), the flat conductor F is positioned so as to extend in the forward-backward direction along the mounting face of the circuit board (not shown) behind the connector 1 in which the movable member 40 has been brought into the closed position (see also FIG. 1). Next, the flat conductor F is forwardly inserted into the receiving portion 17A of the connector 1.

In the process of insertion of the flat conductor F into the receiving portion 17A, the front end of the flat conductor F first abuts the second contact portions 31A of the second contact arm portions 31 of the second terminals 30 and then pushes said second contact portions 31A up under the action of the upwardly directed component of the abutment force, thereby resiliently displacing them upward. Furthermore, when the flat conductor F is inserted, the front end of said flat conductor F abuts the first contact portions 21A of the first contact arm portions 21 of the first terminals 20 and pushes said first contact portions 21A up, thereby resiliently displacing them upward.

Figure 5A:
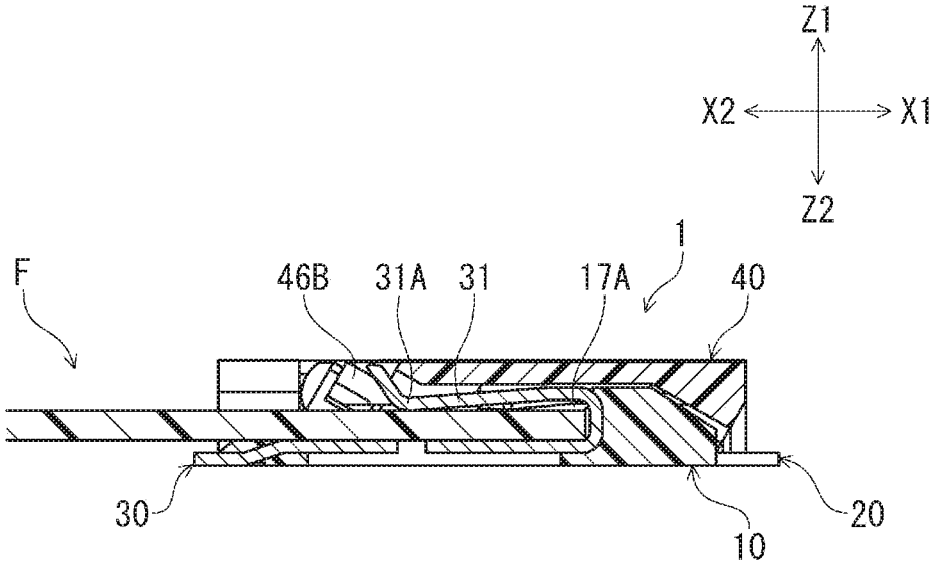

Upon complete insertion of the flat conductor F, the first contact arm portions 21 of the first terminals 20 and the second contact arm portions 31 of the second terminals 30 remain resiliently displaced (see FIG. 5(A)). As a result, the first contact portions 21A and the second contact portions 31A remain in contact with the circuitry of the flat conductor F under contact pressure.

Further, in the process of insertion of the flat conductor F into the receiving portion 17A, the ears F3 positioned proximal to the opposite side edges in the width direction of the flat conductor F abut and make sliding contact with the guide faces 45A-1 of the engaging portions 45A formed in the engaging arm portions 45 of the movable member 40, and the flat conductor F is guided into the regular insertion position in the up-down direction. In addition, under the action of the vertically directed component of the abutment force of the ears F3 against the guide faces 45A-1, the resilient arm portions 45C are resiliently displaced upward and brought into a position that permits insertion of the flat conductor F.

Furthermore, when the flat conductor F is inserted and the ears F3 pass through the location of the engaging portions 45A, the resilient arm portions 45C return to their unencumbered state by being downwardly displaced such that the amount of resilient displacement is reduced, and are push-fitted into the notched portions F2 of the flat conductor F. As a result, upon complete insertion of the flat conductor F, which is seen in FIG. 5(B), the engaged portions F3A of the flat conductor F are positioned in front of the engaging faces 45A-2 of the engaging portions 45A so as to be engageable with said engaging faces 45A-2, thereby preventing rearward disengagement of the flat conductor F. It should be noted that returning to a completely unencumbered state is not essential for the resilient arm portions 45C. For example, it is also possible to use a configuration in which the engaging portions 45A are positioned to be engageable with the engaged portions F3A by push-fitting into the notched portions F2 of the flat conductor F while some residual resilient displacement is still present in the resilient arm portions 45C.

Figure 5B:
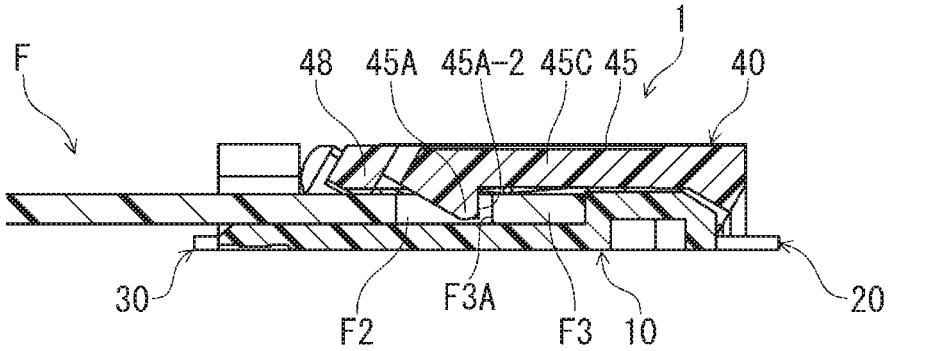
Figure 5C:
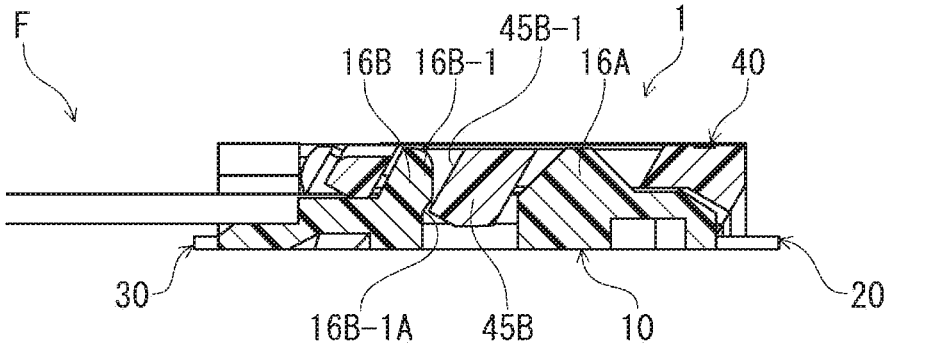

When the flat conductor F is inadvertently pulled rearward in the state illustrated in FIGS. 5(A) to 5(C), in other words, when it is connected to the connector 1, as can be seen in FIGS. 6(A) to 6(C), the flat conductor F moves slightly rearward, but its further rearward movement is prevented because the engaged portions F3A of the flat conductor F engage the engaging faces 45A-2 of the engaging portions 45A of the movable member 40 from the front (see FIG. 6(B)). In addition, as can be seen in FIG. 6(C), simultaneously with the engagement of the engaged portions F3A and the engaging faces 45A-2, the restricted protrusions 45B of the movable member 40 abut the restricting portions 16B-1 of the housing 10 from the front. Specifically, the restricted faces 45B-1 of the restricted protrusions 45B, which are oblique surfaces sloped downward toward the rear, are in surface-to-surface contact with the restricting faces 16B-1A of the restricting portions 16B-1, which are oblique surfaces sloped at the same angle as said restricted faces 45B-1. Therefore, the restricted faces 45B-1 receive a reaction force opposing the abutment force exerted by said restricting faces 45B-1 on the restricting faces 16B-1A from the front (in other words, a rearwardly directed abutment force) from the restricting faces as a forwardly and downwardly directed component force. Further, this forwardly directed reaction force contributes to maintaining the state of engagement between the engaging portions 45A and the engaged portions F3A.

When the flat conductor F is pulled even harder rearward in the state of FIGS. 6(A) to 6(C), that is, in a state wherein the engaged portions F3A engage the engaging portions 45A and, at the same time, the restricted protrusions 45B abut the restricting portions 16B-1 (see FIGS. 7(A) to 7(C)), as can be seen in FIG. 7(C), the restricted protrusions 45B move the restricted faces 45B-1 downward while making sliding contact with the restricting faces 16B-1A under the action of a downwardly directed reaction force (component force) received from the restricting portions 16B-1. As can be seen in FIG. 7(B), the downward movement of the restricted protrusions 45B is permitted by virtue of the fact that the resilient arm portions 45C are resiliently displaced downward. Thus, as a result of the resilient displacement of the resilient arm portions 45C, the engaging portions 45A also move downward and enter even deeper into the notched portions F2 of the flat conductor F.

Thus, in the present embodiment, when the flat conductor F is pulled rearward, the restricted protrusions 45B of the movable member 40 are adapted to receive a downwardly directed reaction force (component force) from the restricting portions 16B-1 of the housing 10, as a consequence of which the restricting portions 16B-1 and, in turn, the engaging portions 45A, will not move upward even if the engaging faces 45A-2 of the engaging portions 45A are worn out as a result of engagement with the engaged portions F3A of the flat conductor F. As a result, the state of abutment between the restricting portions 16B-1 and the restricted protrusions 45B and the state of engagement between the engaging portions 45A and the engaged portions F3A are adequately maintained and inadvertent disengagement of the flat conductor F is adequately is prevented.

In addition, in the present embodiment, the resilient arm portions 45C are resiliently displaced and the engaging portions 45A move downward, thereby making it possible to use the base sections (top end sections coupled to the resilient arm portions 45C in the closed position) of said engaging portions 45A to engage the engaged portions F3A. Although in the present embodiment the engaging portions 45A in the closed position are shaped such that their dimensions in the forward-backward direction become smaller in the downward direction (see FIG. 7(B)), engaging the engaged portions F3A using the base sections of said engaging portions 45A, whose dimensions in the forward-backward direction are larger, makes it possible to counteract the force of disengagement of the flat conductor F with sufficient strength.

In the present embodiment, since oblique surfaces, i.e., the restricting faces 16B-1A and the restricted faces 45B-1, are formed both in the restricting portions 16B-1 and in the restricted protrusions 45B, bringing these oblique surfaces into surface-to-surface contact makes it possible to ensure a large surface area for abutment between the restricting portions 16B-1 and the restricted protrusions 45B and thus bring them into abutment in a more reliable manner. As a result, a downwardly directed reaction force originating from the restricting portions 16B-1 is likely to act on the restricted protrusions 45B. However, it is not essential to form the oblique surfaces both in the restricting portions and the restricted portions, and, as long as a downwardly directed reaction force can be generated, the oblique surfaces may be formed either in the restricting portions or in the restricted portions.

Figure 8B:
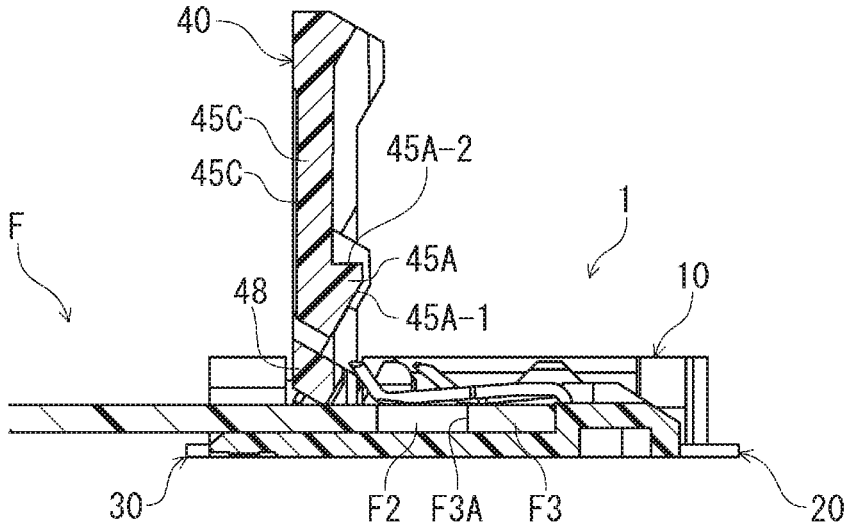
Figure 8C:
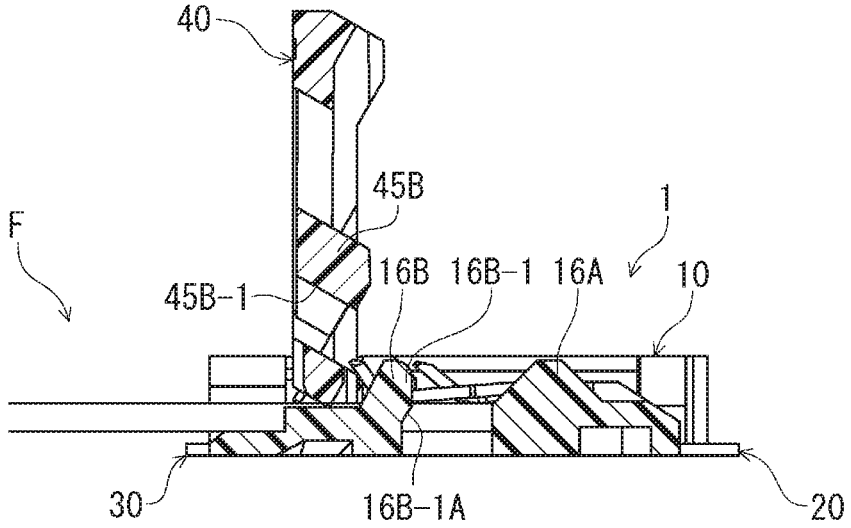

When the connector 1 is intentionally disengaged from the flat conductor F in the state illustrated in FIGS. 5(A) to 5(C), i.e., in the connected state with connector 1, the movable member in the closed position 40 is pivoted so as to bring it into the open position illustrated in FIGS. 8(A) to 8(C). When the movable member 40 is in the open position, the engaging portions 45A of the engaging arm portions 45 of said movable member 40 are moved upward and positioned away from the notched portions F2 of the flat conductor F. In other words, the engaging portions 45A are disengaged from the engaged portions F3A of the flat conductor F, which makes rearward disengagement of the flat conductor F possible. In addition, if the flat conductor F is pulled rearward in this condition, said flat conductor F can be readily disengaged from the connector 1.

Second Embodiment

Although in the first embodiment the restricted portions provided in the engaging arm portions 45 of the movable member 40 are formed as restricted protrusions 45B that protrude outwardly of the engaging portions 45A in the connector width direction and are located in positions different from the engaging portions 45A in the connector width direction, the second embodiment is different from the first embodiment in that the restricted portions are formed in the same locations as the engaging portions in the connector width direction.

The second embodiment will be described below with reference to FIGS. 9(A) to 9(C). Since the connector according to the present embodiment has the same configuration as the connector 1 of the first embodiment with the exception of the restricting portions and the restricted portions, the discussion hereinbelow will focus on the configuration of the restricting portions and the restricted portions. The same parts as those in the first embodiment are assigned the same symbols as the symbols used in the first embodiment and their description is omitted.

Figure 9A:
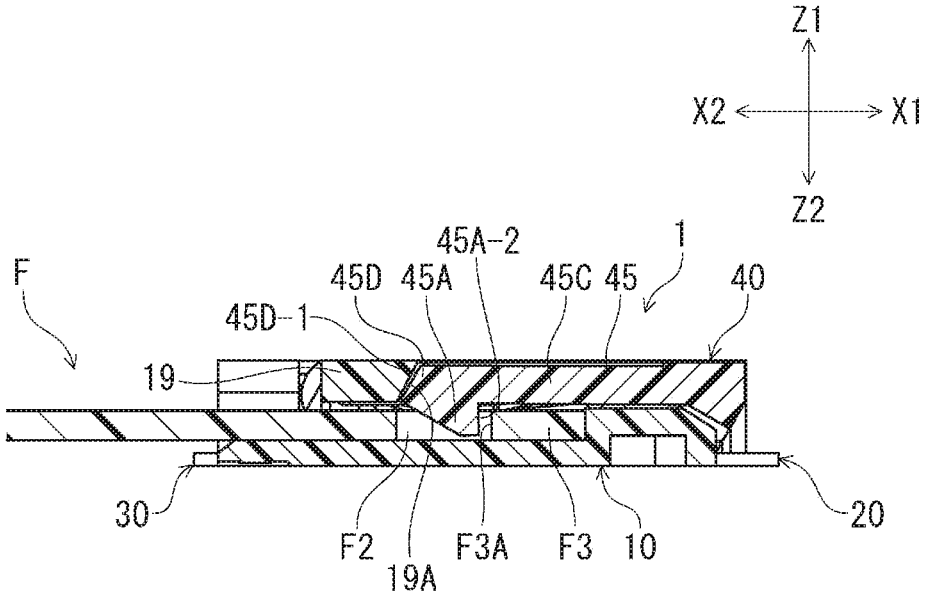
Figure 9B:
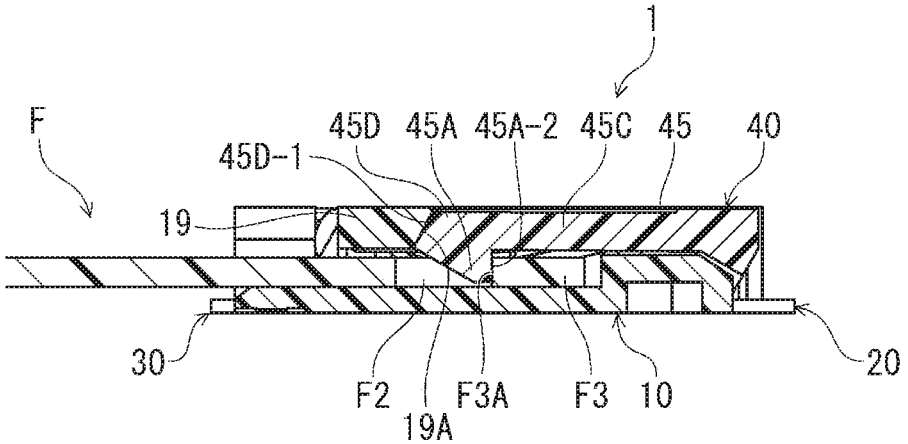
Figure 9C:
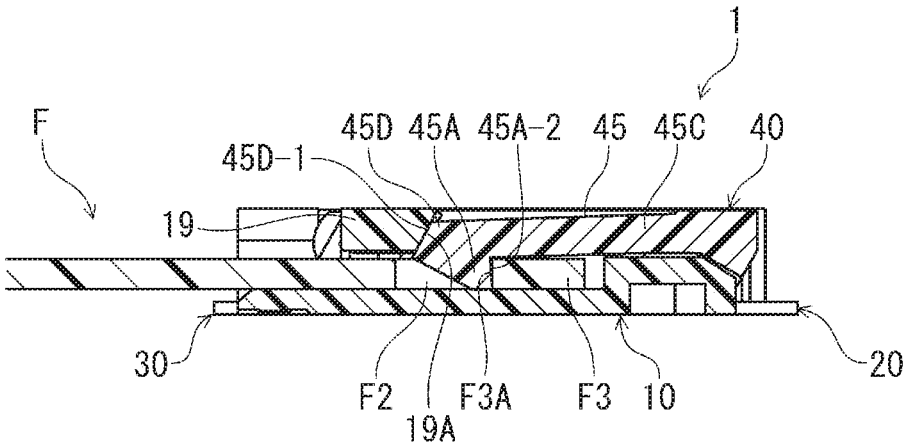

FIGS. 9(A) to 9(C) illustrate vertical cross-sectional views of the connector 1 taken at the location of the engaging arm portions 45 of the movable member 40, wherein FIG. 9(A) is a view obtained after insertion of the flat conductor F, FIG. 9(B) is a view obtained when the flat conductor F is pulled rearward in the state of FIG. 9(A), and FIG. 9(C) is a view obtained when the flat conductor F is pulled further rearward in the state of FIG. 9(B).

In the present embodiment, the restricted portions 45D are formed in the engaging arm portions 45 at the same locations as the engaging portions 45A in the connector width direction. As can be seen in FIG. 9(A-C), the restricted portions 45D are positioned upwardly of the engaging portions 45A at the rear end portions of the resilient arm portions 45C in the closed position and have restricted faces 45D-1 forming oblique surfaces sloped downwardly toward the rear.

In addition, as can be seen in FIGS. 9(A) to 9(C), restricting portions 19 capable of abutting the restricted portions 45D are formed at the same locations in the housing 10 as said restricted portions 45D in the connector width direction, and, at the same time, at locations rearward of the restricted portions 45D in the forward-backward direction. The front faces of said restricting portions 19 are formed as restricting faces 19A forming oblique surfaces sloped in the same orientation and at the same angle as the restricted faces 45D-1 of the restricted portions 45D.

If the flat conductor F is inadvertently pulled rearward when said flat conductor F is connected to the connector 1 (see FIG. 9(A)), in the same manner as in the first embodiment, the engaged portions F3A of the flat conductor F engage the engaging faces 45A-2 of the engaging portions 45A of the movable member 40 from the front (see FIG. 9(B)). In addition, at such time, as can be seen in FIG. 9 (B), the restricted portions 45D of the movable member 40 abut the restricting portions 19 of the housing 10 from the front. Specifically, the restricted faces 45D-1 of the restricted portions 45D are in surface-to-surface contact with the restricting faces 19A of the restricting portions 19. Therefore, the restricted faces 45D-1 receive a reaction force opposing the abutment force exerted by said restricted faces 45D-1 on the restricting faces 19A from the front (in other words, a rearwardly directed abutment force) from the restricting faces as a forwardly and downwardly directed component force. This forwardly directed reaction force contributes to maintaining the state of engagement between the engaging portions 45A and the engaged portions F3A.

Furthermore, if the flat conductor F is pulled strongly rearward in the state of FIG. 9(B), as can be seen in FIG. 9(C), the restricted portions 45D move the restricted faces 45D-1 downward while making sliding contact with the restricting faces 19A under the action of a downwardly directed reaction force (component force) received from the restricting portions 19. As can be seen in FIG. 9(C), the downward movement of the restricted portions 45D is permitted by virtue of the fact that the resilient arm portions 45C are resiliently displaced downward. As a result, in the same manner as in the first embodiment, by virtue of resilient displacement of the resilient arm portions 45C, the engaging portions 45A of the engaging arm portions 45 also move downward and enter even deeper into the notched portions F2 of the flat conductor F, thereby adequately preventing inadvertent disengagement of the flat conductor F.

Although in the first and second embodiments the restricting portions are formed in the housing, alternatively, it is also possible to form them in members mounted to said housing.

In addition, while in the first and second embodiments the movable member is provided with resiliently displaceable engaging arm portions and said engaging arm portions have formed therein engaging portions and restricted portions, alternatively, it is also possible, without providing the movable member with the engaging arm portions, to form engaging portions and restricted portions in a portion of the movable member, for example, in its main body portion.

Although the present embodiments have described examples where the present invention is applied to a connector into and from which a flat conductor is inserted and removed in a direction parallel to the mounting face of a circuit board, alternatively, it is also possible to apply the present invention to a connector in which a flat connector is inserted and removed in a direction perpendicular to the mounting face of a circuit board. In addition, the connector to which the present invention is applied does not necessarily have to be a connector of the type mounted to the mounting face of a circuit board and the present invention can be applied to other types of connectors.

DESCRIPTION OF THE REFERENCE NUMERALS

1 Connector
10 Housing
17A Receiving portion
19 Restricting portion
20 First terminal
30 Second terminal
40 Movable member
45 Engaging arm portion
45C Resilient arm portion
45B Restricted protrusion
45D Restricted portion
F Flat conductor
F3A Engaged portion

The invention claimed is:

1. An electrical connector to which a flat conductor extending in a forward-backward direction is connected, the electrical connector comprising:

a housing having formed therein a receiving portion as a space that is open at least rearwardly for the flat conductor to be forwardly inserted therein, multiple terminals retained in the housing in array form such that a terminal array direction is a direction perpendicular to the forward-backward direction, and a movable member that is provided at the flat conductor insertion location on one side in the connector thickness direction perpendicular to both the forward-backward direction and the terminal array direction and that can move between a closed position configured to prevent disengagement of the flat conductor from the housing in an orientation along the forward-backward direction, and an open position configured to permit disengagement of the flat conductor from the housing in a more angled orientation than the orientation in the closed position, wherein:

the connector comprises restricting portions, which are formed as part of the housing or as members mounted to said housing and are configured to restrict movement of the movable member in the closed position, the movable member comprises:

engaging portions configured to engage engaged portions formed in the flat conductor in the direction of disengagement of said flat conductor at locations outward of the terminal array range in the terminal array direction, and restricted portions configured to abut the restricting portions in the direction of disengagement, wherein at least either the restricting portions or the restricted portions have oblique surfaces rearwardly sloped toward the other side in the connector thickness direction, and, upon complete insertion of the flat conductor, the engaging portions are positioned to be engageable with said engaged portions in the direction of disengagement at locations rearward of the engaged portions of the flat conductor and, when a rearward disengagement force acts on the flat conductor upon complete insertion of said flat conductor, the engaged portions of the flat conductor engage the engaging portions and the restricted portions abut the restricting portions, a result of which at least a reaction force directed toward the other side in the connector thickness direction is received from the restricting portions.

2. The electrical connector according to claim 1, wherein:

the movable member comprises engaging arm portions at locations corresponding to the engaged portions of the flat conductor in the terminal array direction;

the engaging arm portions comprises resilient arm portions, which extend in the forward-backward direction in the closed position and are resiliently displaceable in the connector thickness direction, engaging portions, and restricted portions;

the engaging portions are formed protruding from the rear portion of the resilient arm portions toward the other side in the connector thickness direction; and the restricted portions are either formed in the rear portion of the resilient arm portions, or formed protruding from the rear portion of said resilient arm portions in the terminal array direction.

3. The electrical connector according to claim 1, wherein the restricting portions and the restricted portions have oblique surfaces, and said restricting and restricted portions are configured to come into surface-to-surface contact along the oblique surfaces when a rearward disengagement force acts on the flat conductor upon complete insertion of said flat conductor.

4. The electrical connector according to claim 2, wherein the restricting portions and the restricted portions have oblique surfaces, and said restricting and restricted portions are configured to come into surface-to-surface contact along the oblique surfaces when a rearward disengagement force acts on the flat conductor upon complete insertion of said flat conductor.

5. The electrical connector according to claim 1, wherein the restricted portions are formed at same locations as the engaging portions in the terminal array direction.

6. The electrical connector according to claim 2, wherein the restricted portions are formed at same locations as the engaging portions in the terminal array direction.

7. The electrical connector according to claim 3, wherein the restricted portions are formed at same locations as the engaging portions in the terminal array direction.

8. The electrical connector according to claim 4, wherein the restricted portions are formed at same locations as the engaging portions in the terminal array direction.

* * * * *